United States Patent [19]

Jones

[11] Patent Number: 4,518,632

[45] Date of Patent: May 21, 1985

[54] METALLIZED SYNTHETIC CABLE

[75] Inventor: Thomas E. Jones, Spring Valley, Calif.

[73] Assignee: The United States of America as represented by the Secretary of the Navy, Washington, D.C.

[21] Appl. No.: 601,751

[22] Filed: Apr. 18, 1984

[51] Int. Cl.[3] ..... B05D 5/12

[52] U.S. Cl. ..... 427/118; 427/123; 427/404; 427/407.1; 427/430.1; 427/443.1; 428/367; 428/381; 428/395; 428/902; 174/120 C; 174/120 SR; 174/128 BL; 174/102 R; 204/38.7

[58] Field of Search ..... 428/367, 902, 378, 379, 428/381, 395; 174/36, 120 C, 120 SR, 128 BL, 102 R; 427/118, 123, 404, 407.1, 430.1, 443.1; 204/38 E

[56] References Cited

U.S. PATENT DOCUMENTS

| | | | |
|---|---|---|---|
| 3,833,402 | 9/1974 | Elban et al. | 428/902 |
| 4,231,535 | 11/1980 | Schlegel et al. | 428/902 |
| 4,301,428 | 11/1981 | Mayer | 174/36 |

*Primary Examiner*—Richard Bueker

*Attorney, Agent, or Firm*—Robert F. Beers; Ervin F. Johnston; Thomas Glenn Keough

[57] ABSTRACT

A method and apparatus provides an essentially neutrally buoyant undersea electronic data communications link. A bundle of continuous synthetic fibers each having a diameter of about ten microns has individualized metallized layers coated to a thickness of about one to three microns and the whole lot is covered by dielectric insulation. The synthetic fibers, aromatic polyamide fibers or graphite fibers, are relatively light-weight yet have high tensile strengths to assure a sufficient load bearing capability for the undersea use and the number of thin metallized coatings provide the electrical data transmission capability without unduly weighting down the cable. The dielectric insulation layer is disposed coaxially outwardly of the coated fibers and optionally is provided with an outer sheath of conductive material for a return path. However in some applications a seawater return path is better. The size of the undersea link is variable to accommodate different frequency responses and the material of the metallized layers is variable to allow for different weights and desired transmission characteristics. Optionally, the fibers can be intercalated fibers to aid in the transmission of signals.

10 Claims, 11 Drawing Figures

ATTENUATION IN dB FOR 1000 FT LENGTH FOR SEVERAL STRANDED CABLES WITH SEAWATER RETURN

| $r_2$ (m) | N OF STRANDS | f = 100 kHz | | | f = 200 kHz | | | f = 501 kHz | | | f = 1000 kHz | | | f = 501 kHz | |
|---|---|---|---|---|---|---|---|---|---|---|---|---|---|---|---|
| | | A | B | C | A | B | C | A | B | C | A | B | C | D | E |
| .0005 | 6000 | * | * | 5.906 | * | * | 9.105 | * | * | 18.975 | * | * | 35.721 | | |
| | 5000 | * | 6.550 | 5.186 | * | 11.077 | 7.756 | * | 25.150 | 15.658 | * | 49.101 | 29.041 | | |
| | 4000 | 8.192 | 4.606 | 4.877 | 14.348 | 7.544 | 7.025 | 33.522 | 16.654 | 13.594 | 66.187 | 32.138 | 24.693 | | |
| | 3000 | 4.326 | 3.915 | 4.899 | 7.299 | 6.130 | 6.732 | 16.537 | 12.974 | 12.276 | 32.250 | 24.583 | 21.609 | 16.083 | 393.4 |
| | 1500 | 3.382 | 3.937 | 6.062 | 5.126 | 5.495 | 7.565 | 10.495 | 10.224 | 11.848 | 19.584 | 18.193 | 18.938 | | |
| | 1000 | 3.572 | 4.481 | 7.381 | 5.058 | 5.872 | 8.881 | 9.588 | 10.008 | 12.801 | 17.226 | 16.929 | 19.150 | 24.054 | 522.0 |
| | 800 | 3.808 | 4.931 | 8.321 | 5.200 | 6.269 | 9.894 | 9.407 | 10.169 | 13.699 | 16.478 | 16.659 | 19.741 | | |
| | 600 | 4.250 | 5.685 | 9.769 | 5.556 | 6.995 | 11.545 | 9.436 | 10.660 | 15.305 | 15.926 | 16.697 | 21.038 | | |
| | 400 | 5.165 | 7.122 | 12.267 | 6.412 | 8.491 | 14.616 | 9.960 | 11.947 | 18.588 | 15.825 | 17.496 | 24.050 | 40.867 | 711.6 |
| .0010 | 6000 | 2.170 | 2.157 | 2.605 | 3.970 | 3.737 | 4.015 | 9.592 | 8.655 | 8.366 | 19.183 | 17.031 | 15.746 | | |
| | 5000 | 2.078 | 2.137 | 2.703 | 3.732 | 3.614 | 4.042 | 8.892 | 8.205 | 8.159 | 17.689 | 16.015 | 15.129 | | |
| | 4000 | 2.015 | 2.155 | 2.877 | 3.529 | 3.529 | 4.144 | 8.244 | 7.789 | 8.018 | 16.273 | 15.027 | 14.562 | | |
| | 3000 | 2.000 | 2.241 | 3.197 | 3.374 | 3.510 | 4.392 | 7.644 | 7.426 | 8.008 | 14.905 | 14.069 | 14.094 | 11.508 | 281.5 |
| | 1500 | 2.232 | 2.775 | 4.511 | 3.383 | 3.873 | 5.630 | 6.925 | 7.206 | 8.816 | 12.921 | 12.819 | 14.090 | | |
| | 1000 | 2.565 | 3.357 | 5.743 | 3.632 | 4.400 | 6.910 | 6.883 | 7.498 | 9.958 | 12.364 | 12.680 | 14.895 | 19.364 | 420.3 |
| | 800 | 2.825 | 3.789 | 6.599 | 3.859 | 4.817 | 7.846 | 6.979 | 7.812 | 10.863 | 12.223 | 12.795 | 15.652 | | |
| | 600 | 3.261 | 4.486 | 7.909 | 4.264 | 5.518 | 9.346 | 7.241 | 8.409 | 12.390 | 12.218 | 13.169 | 17.028 | | |
| | 400 | 4.109 | 5.786 | 10.167 | 5.102 | 6.898 | 12.114 | 7.923 | 9.705 | 15.406 | 12.587 | 14.210 | 19.930 | 34.544 | 601.5 |
| .0020 | 6000 | 1.432 | 1.521 | 1.938 | 2.619 | 2.634 | 2.987 | 6.326 | 6.097 | 6.222 | 12.644 | 11.989 | 11.703 | | |
| | 5000 | 1.431 | 1.553 | 2.056 | 2.570 | 2.626 | 3.074 | 6.121 | 5.958 | 6.202 | 12.170 | 11.623 | 11.494 | | |
| | 4000 | 1.447 | 1.614 | 2.238 | 2.533 | 2.643 | 3.224 | 5.915 | 5.832 | 6.235 | 11.669 | 11.245 | 11.316 | | |
| | 3000 | 1.496 | 1.733 | 2.547 | 2.524 | 2.713 | 3.500 | 5.715 | 5.739 | 6.379 | 11.137 | 10.865 | 11.220 | 9.431 | 230.8 |
| | 1500 | 1.785 | 2.264 | 3.751 | 2.704 | 3.158 | 4.681 | 5.533 | 5.874 | 7.328 | 10.317 | 10.444 | 11.704 | | |
| | 1000 | 2.105 | 2.799 | 4.862 | 2.980 | 3.668 | 5.850 | 5.646 | 6.248 | 8.429 | 10.136 | 10.560 | 12.601 | 16.652 | 361.5 |
| | 800 | 2.347 | 3.191 | 5.636 | 3.204 | 4.056 | 6.700 | 5.794 | 6.576 | 9.274 | 10.141 | 10.765 | 13.356 | | |
| | 600 | 2.745 | 3.822 | 6.821 | 3.589 | 4.701 | 8.060 | 6.092 | 7.162 | 10.682 | 10.272 | 11.209 | 14.675 | | |
| | 400 | 3.515 | 4.998 | 8.873 | 4.363 | 5.959 | 10.572 | 6.774 | 8.381 | 13.442 | 10.755 | 12.265 | 17.383 | 30.465 | 530.5 |

LEGEND

A - 3$\mu$m thick copper on 4.2$\mu$m radius inert fiber
B - 2$\mu$m thick copper on 4.2$\mu$m radius inert fiber
C - 1$\mu$m thick copper on 4.2$\mu$m radius inert fiber
D - Solid intercalated graphite, 4.2$\mu$m radius
E - Solid graphite, 4.2$\mu$m radius
* Impossible dimensions

FIG. 10

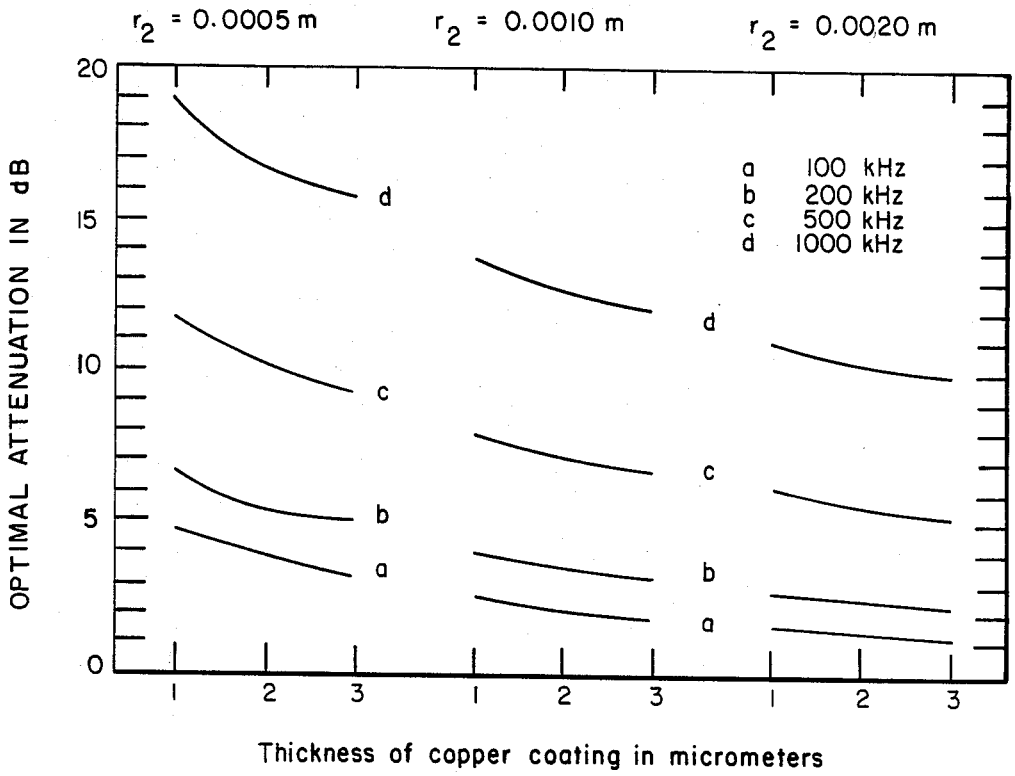
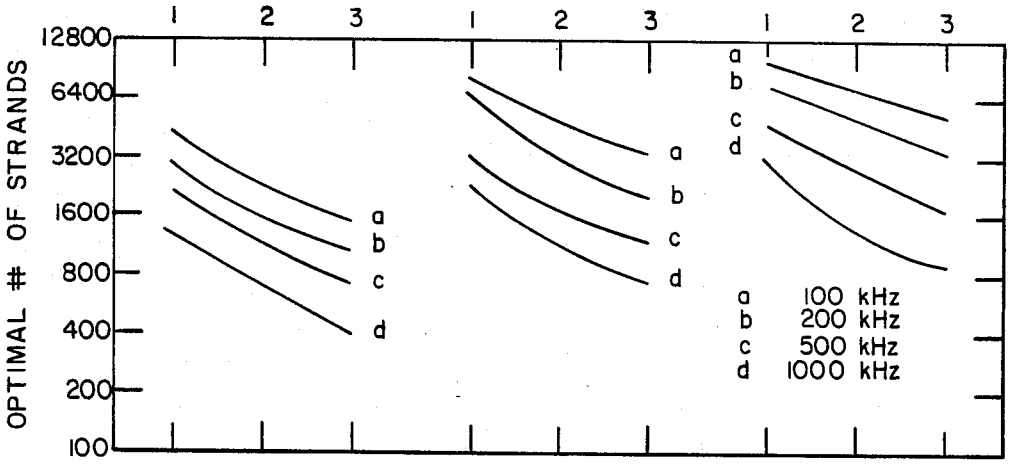
OPTIMAL ATTENUATION AND NUMBER OF STRANDS FOR A CABLE WITH SEAWATER RETURN
FIG. 11

METALLIZED SYNTHETIC CABLE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The continuing evolution of all aspects of undersea technologies has produced an astounding variety of innovations which help to solve the many formidable problems posed by this inhospitable frontier. One area where solutions are needed involves the numerous data gathering sensors required for meaningful analysis and proper action. They must have reliable data transmission links that span the distance between the sensors and central processing facilities.

While some noteworthy advances have been made in the optoelectronic field, the more or less conventional electronic sensors and their associated electrical cables have left something to be desired. The limitations of the conventional designs have been made particularly acute in applications where the data link is to communicate the sensor's informations from great depths to the surface. Although ideally such an electrical link should transmit the desired information with little or no attenuation, be light in weight and neutrally buoyant as well as very strong, flexible and inexpensive, the weight of suspended electrical cables can be immense. The current cable systems based on copper conductors meet many of these criteria and for this reason copper conductors are usually the material of choice with current technology. However, copper is less than an ideal material when it's weight is considered (specific gravity is about 8.7). Furthermore, the general deterioration of copper in an ocean environment when elaborate safeguards aren't provided and the increasing cost of copper for some expendible systems, make the selection of copper conductors a doubtful choice in some deep ocean applications.

In recent years a nearly neutrally buoyant undersea cable has been developed and widely used. It has a number of copper conductors alone or in combination with a conventional coaxial design and can extend for several hundred feet through the ocean. Floats are attached at predetermined intervals along the length of the cable to make it neutrally buoyant and care must be taken when the cable is being deployed or retrieved to guard against damaging the floats. Obviously this arrangement is bulky and requires special handling considerations. The bulk and mass of this arrangement also poses problems where ocean currents are expected as well as the problems associated with deployment and retrievement through the air ocean interface during high sea states.

Thus, there is a continuing need in the state of the art for an essentially neutrally buoyant undersea electronic data communication link that has a sufficient strength to assure completion of the job as well as possessing suitable bandwidth and frequency response characteristics while being of compact size.

SUMMARY OF THE INVENTION

The present invention is directed to providing a method of fabricating an essentially neutrally buoyant undersea data communications link and a suitable apparatus therefor. At least one continuous synthetic fiber is provided having a diameter of between eight and ten microns, a weight of between 1.75 and 2.2 grams per cubic centimeter and a tensile strength in the range of 200,000 to 400,000 lbs/in$^2$ (1.4–2.8 GPa). Coating each continuous fiber with a metallized layer to a one to three micron thickness provides the low resistance data pathway. A dielectric insulation covers the coated fibers, protects them and insulates them from the surrounding seawater which can function as an electrical return path or a metal sheath is provided on the outside of the dielectric insulation for that purpose.

A prime object of the invention is to provide an improved data transmission cable.

Yet another object is to provide an undersea data transmission cable that is essentially neutrally buoyant.

Still another object of the invention is to provide a neutrally buoyant undersea cable using a number of synthetic fibers as the tensile load bearing members.

Still another object is to provide a neutrally buoyant undersea data transmission cable having metallic coated fibers serving as electrical pathways and as the load bearing members.

Still another object is to provide a multitude of metal coated fibers within a dielectric insulation being of small diameter and proper density to be suspended in the ocean without unduly creating bulk and drag.

Yet a further object is to provide metallic coated fibers possessing sufficient strengths and integrity to withstand the abuses of a marine environment.

These and other objects of the invention will become more readily apparent from the ensuing specification and drawings when taken with the appended claims.

BRIEF DESCRIPTION OF THE DRAWINGS

FIG. 10 is an attenuation in dB for 1000 ft length for several stranded cables with seawater return.

FIG. 11 depicts an optimal attenuation and number of strands for a cable with seawater return.

DESCRIPTION OF THE PREFERRED EMBODIMENT

Figure 1:
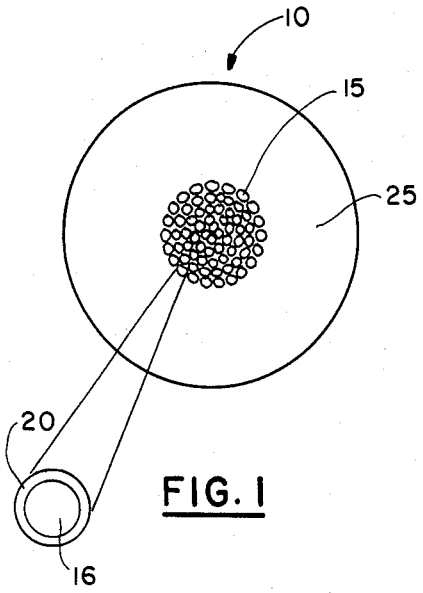
FIG. 1 is a cross-sectional representation of a coaxial bundle of metallized synthetic fibers designed to make use of a seawater return path.

Referring now to FIG. 1 of the drawings, an essentially neutrally buoyant undersea electrical data transmission cable 10 has its constituents discretely fabricated and arranged to assure functional capabilities while having a structural integrity for survival in the hostile marine environment.

The undersea data communications link has a bundle 15 of from one to any practicable number of synthetic fibers 16 usually arranged in a bundle that are each coated with a metallized layer 20. Each of the synthetic fibers continuously extends the entire desired length of the data communications link and functions primarily as the tensile load bearing member that provides structural integrity for the link.

The synthetic fibers which have been shown to be acceptable for the intended purpose are relatively small, about eight to ten microns in diameter and are selected from commercially available fibers which have demonstrated high tensile strength, low susceptibility to the corrosive marine environment, and a density or weight which is compatible with the design of a neutrally buoyant undersea link. Fibers of an aromatic polyamide or aramid material such as that marketed under the trademark KEVLAR by DuPont D Nemours, E. I. and Company has proven satisfactory for this use. This material has the extremely high tensile strength, greater resistance to elongation than steel, low density, corrosion resistance and handling properties which make it a likely candidate for the envisioned application. Graphite fibers available from a number of sources have also shown to be equally acceptable as the tensile strength member in the undersea communications link. Dopants introduced into the graphite fiber or rather fibers made from graphite intercalation compounds have also shown some promises with the improved conductivity of such fibers providing additional data communication capabilities without overly compromising the strength needs of the fibers. Comparisons of the strength conductivities, weights etc. will be elaborated on below.

The material of the metallized layers coated on the fibers can be of several likely candidates. Copper, aluminum, nickel, etc. have performed well enough under a variety of parameters. The weight of the coating determined by its density may tip the scales in favor of one material over another while the conductivity and frequency attenuation characteristics of another will call for the selection of another material in different circumstances. Typically the metallization layer has a DC resistance of approximately one ohm per foot for a 100 fiber bundle. Irrespective what material is chosen for the metallized layer, the end result is light-weight, albeit neutrally buoyant composite cable that is ideally suited for undersea deployment.

The metallized layer is coated on the synthetic fibers to a one to three micron thickness in accordance with electrodeposition processes already developed in the art. Electroplating of carbon or graphite fibers with the metallized layers is well established as set forth in the article entitled "Electroplated Carbon/Graphite Fibers" C. P. Beets, Jr. and R. J. Schmitt, American Cyanamid Co., *SAMPE Journal* May/June 1983. The techniques disclosed in the article primarily concern carbon or graphite fibers but would lend itself very well to the coating of aramid fibers as well as intercalated fibers. Commercially available sources for metal plating the fibers would be, for example, MCI Inc., 666 North Hague Ave., Columbus, Ohio 43204, Celanese Plastics and Specialities Co., 26 Main Street, Chatham, N.J. 07928 or American Cyanamid Company, Chemical Research Division, Stamford, Conn. Various metallized layers of a desired thickness can be applied to synthetic fibers in accordance with their processes and, as such, will function satisfactorily in the intended application of a neutrally buoyant undersea cable.

An annular dielectric layer 25 covers the metallized layer continuously throughout its length. It can be extruded in place or otherwise suitably affixed. Preferably it eliminates voids or other pockets which would make the composite cable susceptible to ambient pressure variations. The material of the dielectric layer is any one of a number of proven insulation materials. Foamed polystyrene (styrofoam), foamed polyethylene, polytetrafluoroethylene (Teflon), ethylene propylene, polyisobutylene, butyl rubber, silicon rubber, etc. function properly so long as the composite density of the synthetic fiber core, metallized layer and insulative layer approaches or equals that of seawater. The dielectric layer has properties which will protect the metallized layer from damage during deployment and retrieval as well as affording a degree of protection from marine predators and has a flexibility to allow coiled storage on a reel and ruggedness for passing through sheaves. The dielectric layer thickness is sufficient as to prevent arcing from the metallized layers along the length of the cable.

A cable fabricated from a number or bundle of fibers each coated with a metallic layer and all covered by the insulative layer may use a seawater return path. Seawater return paths have been found to be quite acceptable for a host of considerations and often times do provide less impedance than a specially provided conductor for a return path. An outer sheath 30 of a suitable metal such as copper or aluminum can be provided for the electrical return path, see FIG. 2. This, however, has been found to impose certain limitations since it adds weight and may be susceptible to the corrosive influences of the marine environment. Yet, the conductive sheath does provide for an increased protection of the cable and may be more suitable for some applications.

Figure 3:
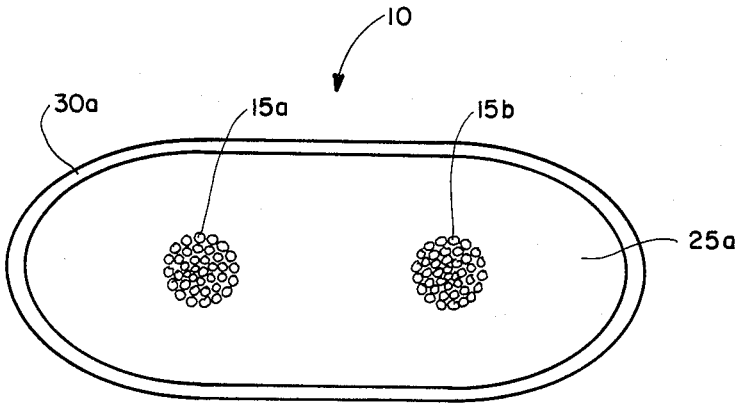
FIG. 3 shows a shielded pair of bundles of metallized synthetic fibers in accordance with this inventive concept.

An alternate embodiment is shown in FIG. 3. The pair 15*a* and 15*b* of bundles of metallized fibers are separated one from the other by the insulator 25*a*. An outer metal sheath 30*a* shields the pair. Frequency response and attenuation improvements may be provided by this design.

The composite cable described above, made up from a number of synthetic fibers each coated with a metallized layer and all covered by at least an insulative layer and, optionally, an outer conductor, has a wide variety of electrical transmission properties. Frequency response as well as attenuation are most noteworthy among these properties and, by having more or less metallized layer coated fibers with varying thicknesses of the metallized layers, the data communication needs of a variety of undersea systems can be accommodated. This capability gives designers wide latitude for responsively monitoring remote sensors to assure that the gathered signals are not compromised by the transmission paths.

It was found that various conducting materials, covering a very wide range of electrical conductivities of between $10^4$ to $10^8$ mhos/meter may be used in appropriate configurations. Material and geometric parameters have been varied to obtain a power-loss versus design-parameter tradeoff. The attenuation is proportional to the cable length and calculations are usually illustrated for lengths of one thousand feet. The frequency response is considered wide enough for most undersea applications and one hundred thousand hertz as the upper frequency limit will provide a frequency range having the required bandwidth for transmission of many underwater sensors such as hydrophones. Performance characteristics to follow are given as a function of conductivity so that a system designer is free to relate to available power, detectable power levels and bandwidth requirements to the reported attenuation-conductivity characteristic to arrive at an appropriate design.

Figure 2:
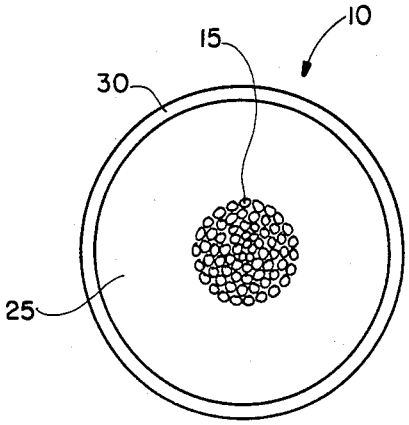
FIG. 2 shows the bundle of metallized synthetic fibers having an external metal sheath functioning as the return path.

Coaxial cables of FIGS. 1 and 2 and shielded pair cables of FIG. 3 are valid potential configurations for the essentially neutrally buoyant undersea cable envisioned within this inventive concept. Solid unmetallized nonmetallic conductors may be useful as the load bearing small-diameter cables if conductivities approximately equal to 0.1 that of copper are provided. The diameter of the solid unmetallized nonmetallic conductors normally must be significantly larger if the conductivities of only 0.01 of that of copper are available. As mentioned before, the inclusion of solid unmetallized nonmetallic conductors incorporating intercalated materials are not settled.

Figure 4:
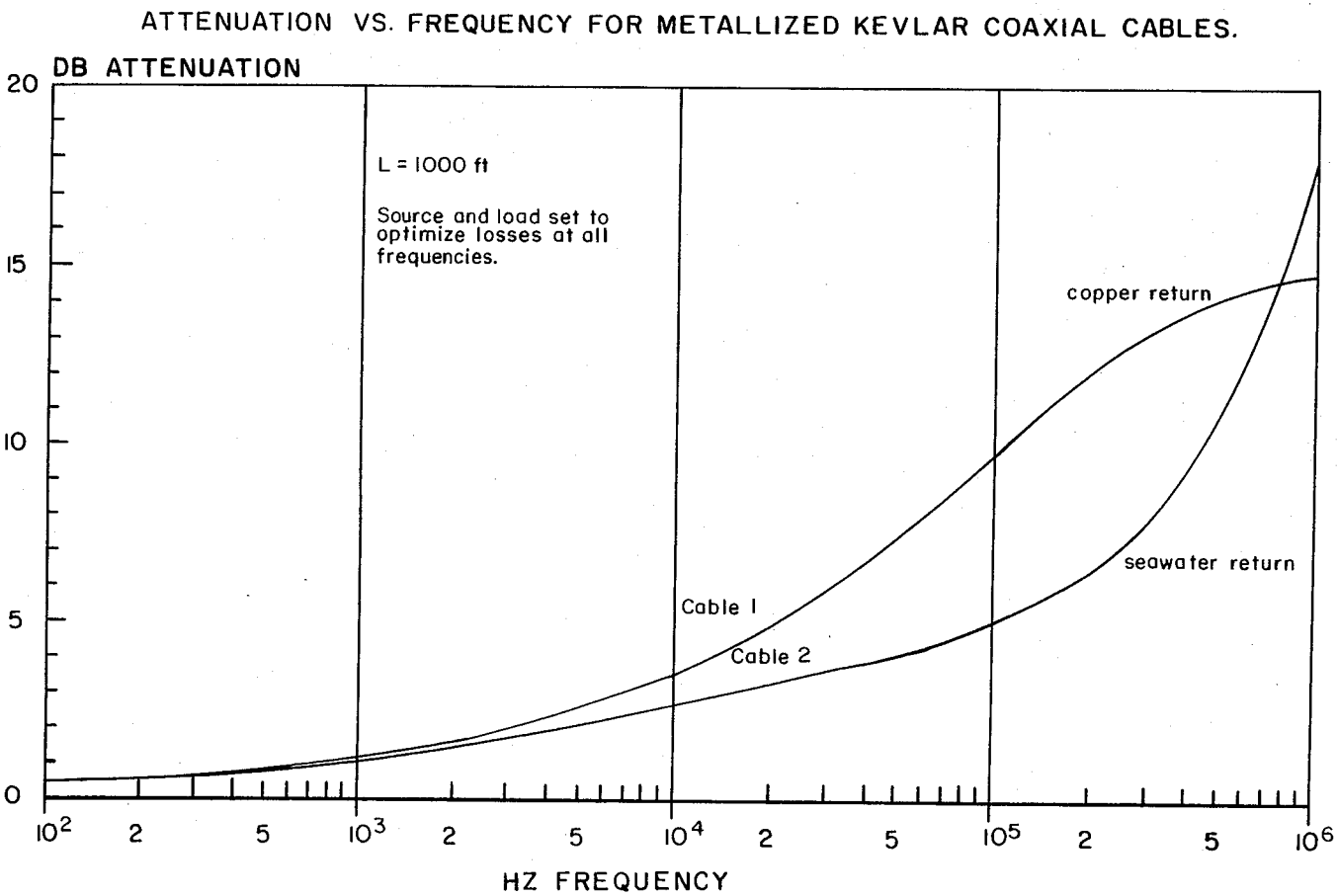
FIG. 4 depicts an attenuation vs. frequency for metallized Kevlar coaxial cables. Cable 2 has a seawater return; cable 1 has a copper return. Inner conductor is a 2000 fiber bundle of metallized Kevlar.
Figure 5:
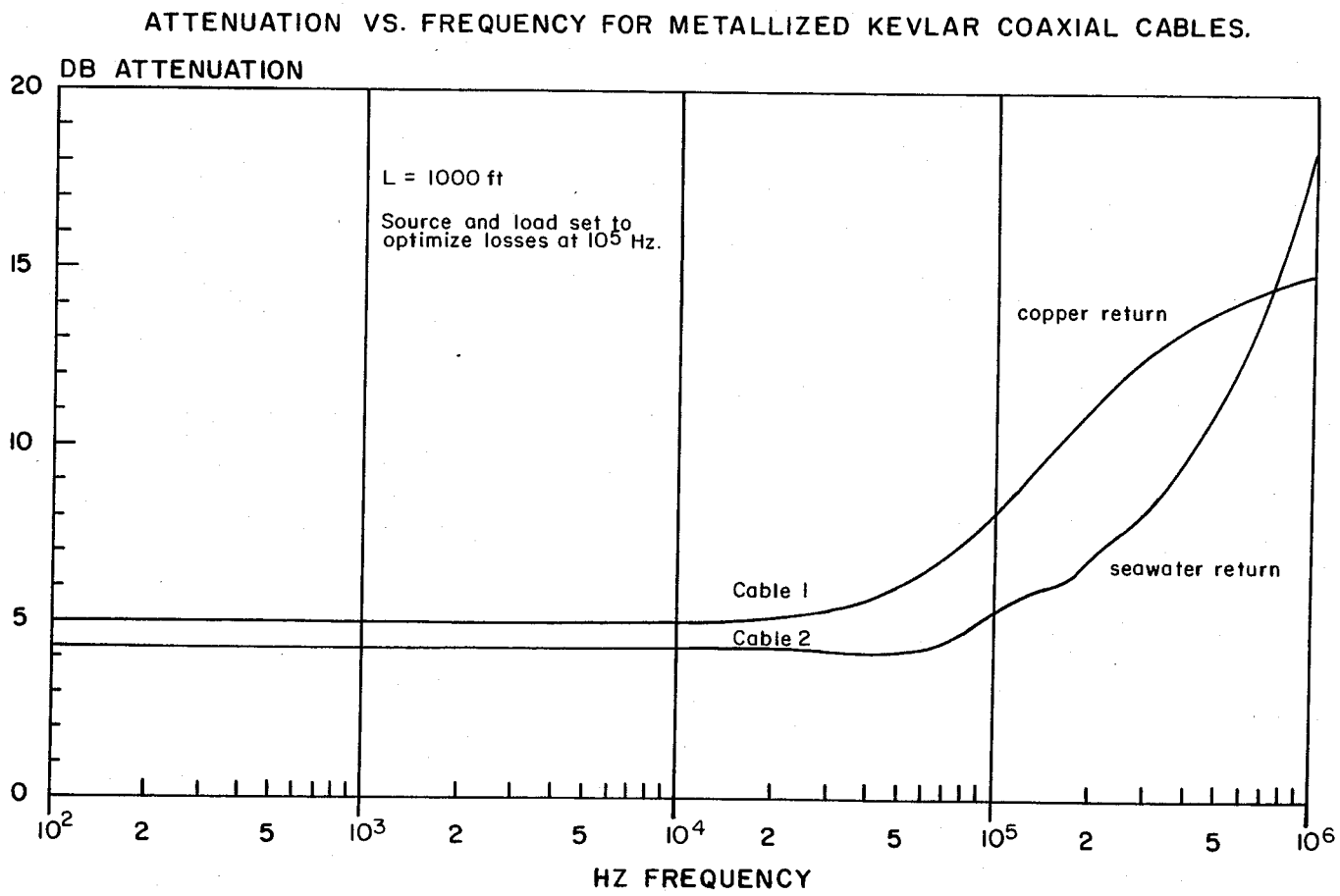
FIG. 5 shows an attenuation vs. frequency for metallized Kevlar coaxial cables. Curve 2 has a seawater return; curve 1 has a copper return. Inner conductor is a 2000 fiber bundle of metallized Kevlar.
Figure 6:
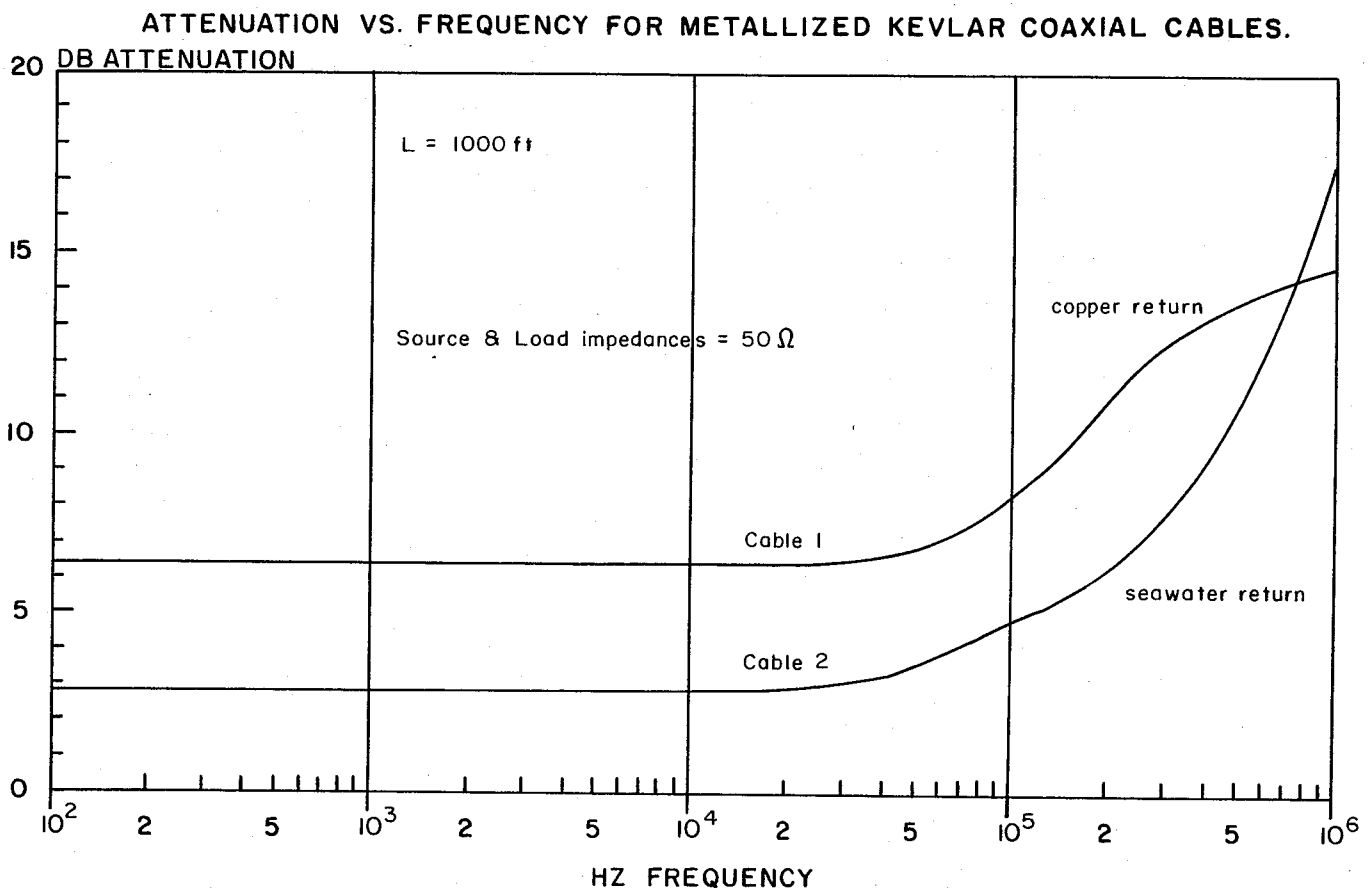
FIG. 6 depicts an attenuation vs. frequency for the 2000 fiber bundles of metallized Kevlar for coaxial cables. Curve 2 has a seawater return; curve 1 has a copper return. Source and load impedance were 50 ohms.

Important to the realization of this inventive concept is fabricating the inner conductor of many small strands of copper-coated KEVLAR or graphite, surrounded by a dielectric and relying on a seawater return path to provide the low-loss broadband, strong inexpensive undersea data transmission line. In this regard KEVLAR seems to have the edge since it is lower in cost and higher in strength than the graphite lines. Looking to FIGS. 4, 5 and 6 the effect of a seawater return are shown on cables using metallized Kevlar fibers as the inner conductor. Curve 1 represents the case for a copper return and curve 2 the seawater return. The inner conductor consisted of 2000 Kevlar fibers each with a radius of 5.97 micrometers. The thickness of the metal layer was 1 micrometer in all cases. The outer radius of the inert material surrounding the inner conductor was 0.539 mm. The metal return had an outer radius of 0.600 mm. FIG. 4 represents the attenuation for optimum source and load impedances. FIG. 5 has fixed source and load impedances for minimum attenuation at 100 khz. The curves in FIG. 6 were calculated using source and load impedances of 50 ohms each.

Figure 7:
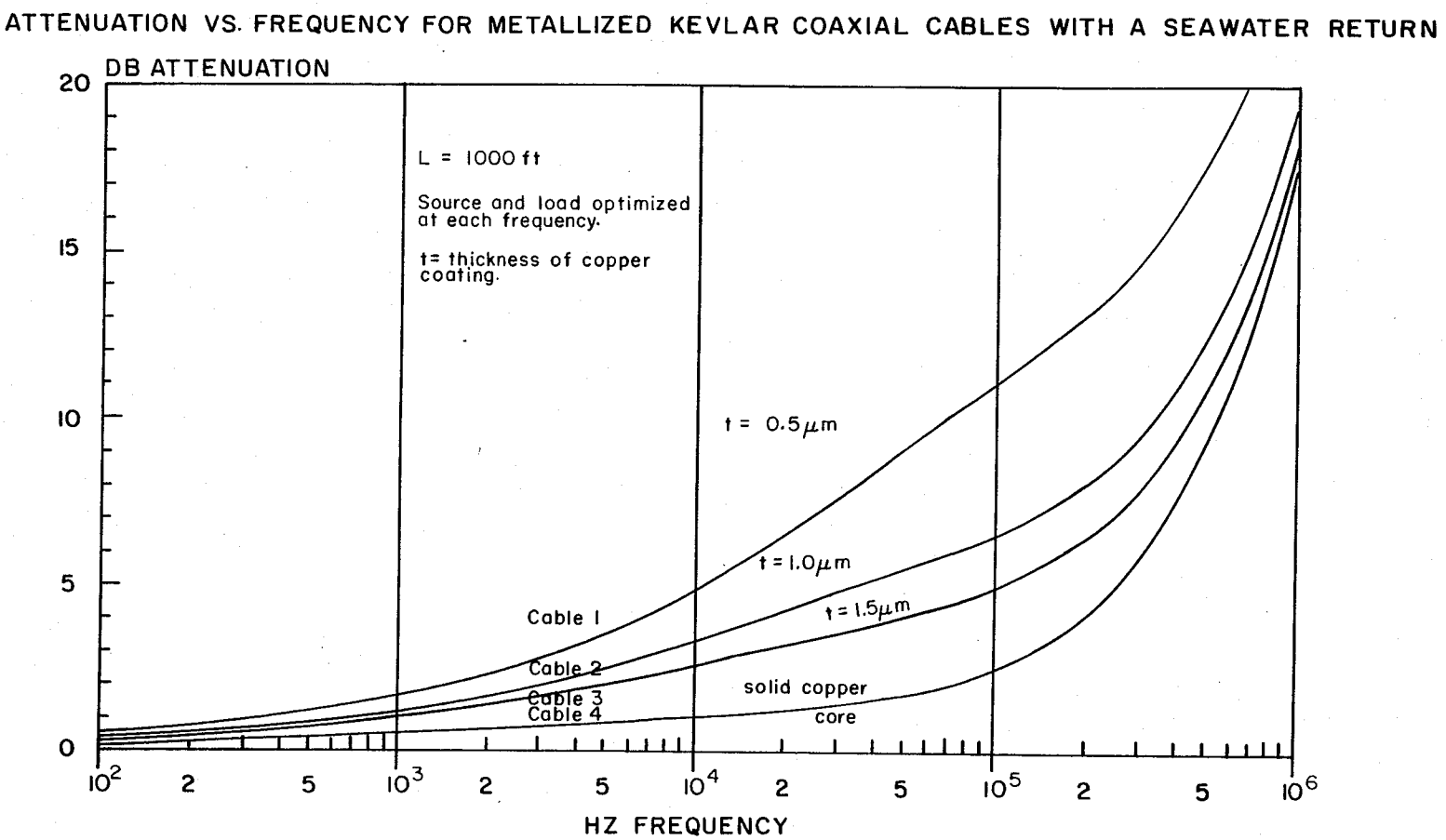
FIG. 7 shows an attenuation vs. frequency for metallized Kevlar coaxial cables with a seawater return. Source and load set minimize losses at each frequency.
Figure 8:
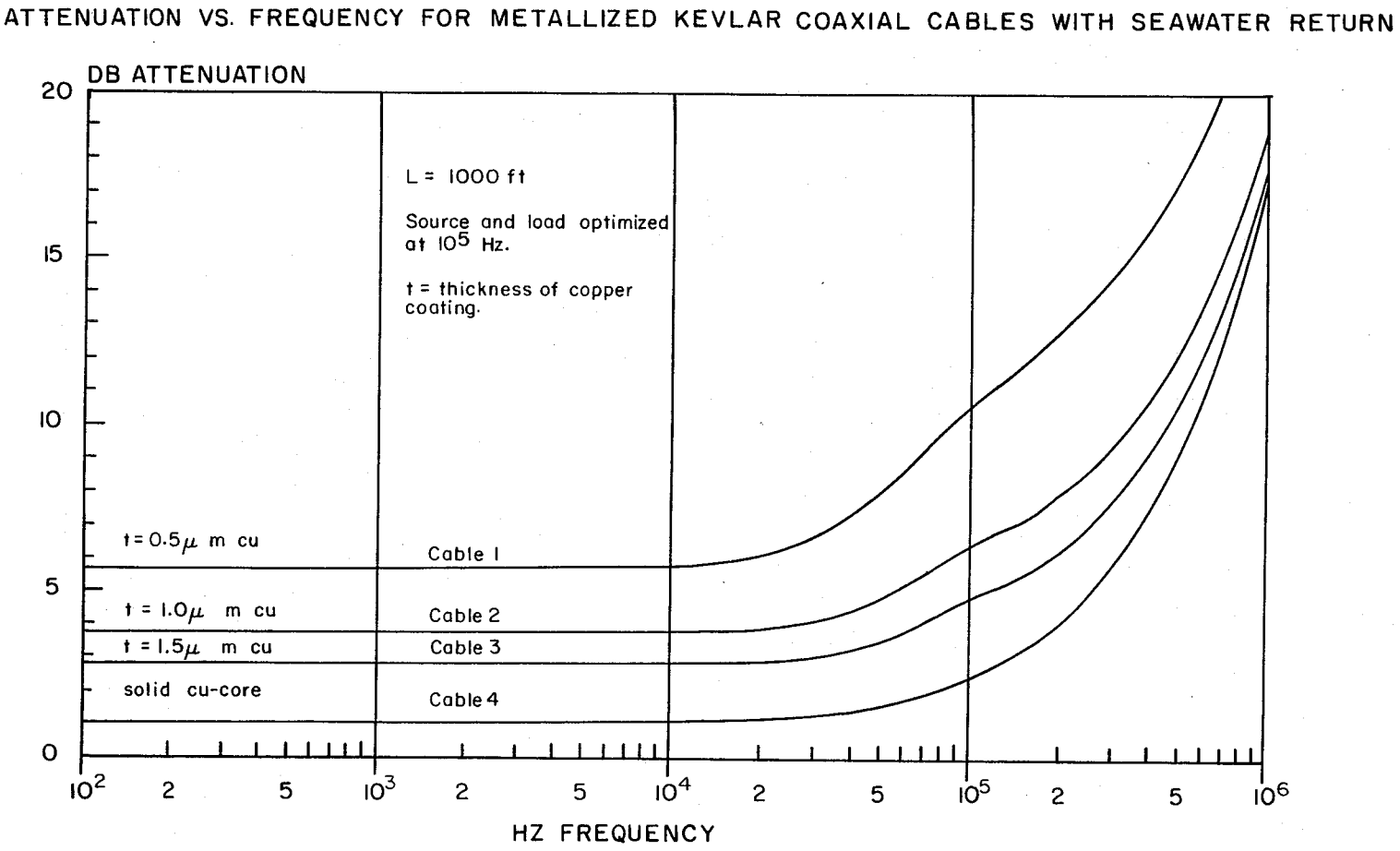
FIG. 8 is an attenuation vs. frequency for metallized Kevlar coaxial cables with seawater return.
Figure 9:
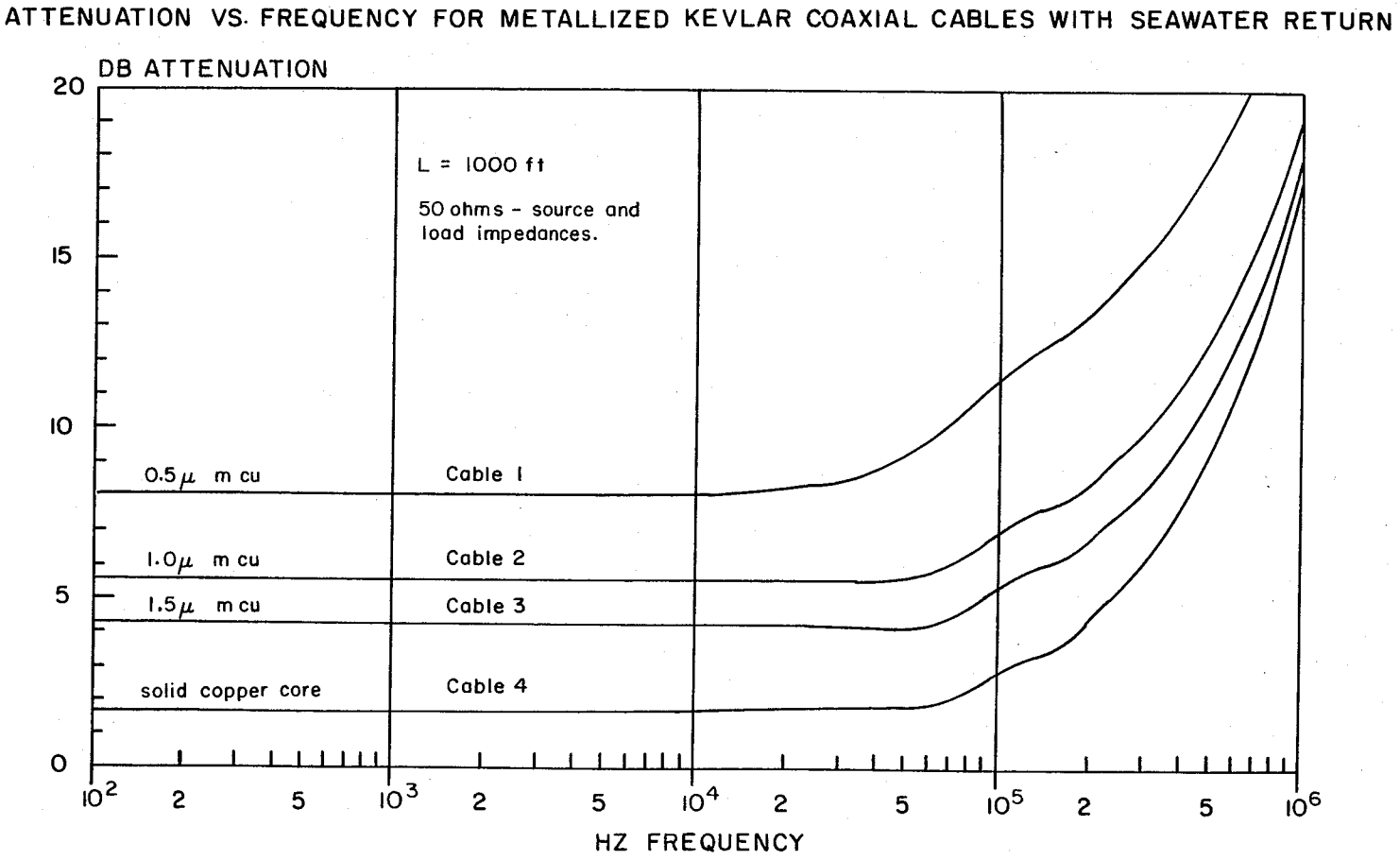
FIG. 9 depicts attenuation vs. frequency for metallized Kevlar coaxial cables with seawater return.

FIGS. 7, 8 and 9 show the effect of varying the metal thickness for cables with seawater returns. All the curves represent the attenuation of cables with the same parameters discussed with respect to FIGS. 4, 5, and 6 except that curves 1, 2, and 3 correspond to metal thicknesses of 0.5, 1.0, and 1.5 micrometers of copper respectively. FIGS. 7, 8 and 9 have source and load impedances which are optimized at all frequencies, matched at 100 khz, and 50 ohms constant respectively. Curve 4 is the attenuation for a cable having a solid copper core and is given as a reference.

Close examination of the FIGS. will reveal that, depending on the operating frequency, it is not always better to have more metallization or more fibers. The external size was fixed so that more metallization or more fibers required less dielectric, hence more capacitance and more high frequency loss. At low frequencies, more metallization always reduced losses. The crossover frequencies varied from 200 khz to 800 khz with 0.5 to 1.5 micrometers of metallization. The dielectric dissipation factor is negligible in almost all cases.

Thus, cables such as these are capable of being optimized for small total diameters, large numbers of fibers, and high frequencies of operation. Optimization and useful results are illustrated in the following analysis.

A combination of stranded inner conductors and seawater-return outer conductors has led to the favorable results that are shown in the above referred to FIGS. Stranded conductors offer a subsantial design advantage for cables with bandwidth less than approximately 1 MHz.

Noting FIG. 10 the stranded conductors have copper coatings on inert fibers such as Kevlar (that is very strong and lightweight) or low-conductivity graphite, fibers of uncoated graphite, and fibers of intercalated graphite that have high conductivity. The radius of each synthetic fiber strand is assumed to be 4.2 microns with the possible addition of a copper coating of 1, 2 or 3 microns. The number of strands ranges from 400 to 6,000.

A general observation for the seawater return coaxial lines is that bigger cables have lower losses. Therefore, for a fair comparison of different lines, the radius $r_2$ of the outer dielectric surface is kept constant and other parameters are varied. FIG. 10 gives the attenuation at frequencies of 100, 200, 500 and 1000 kHz for five types of stranded cables with seawater return. In general, the attenuation is low for the copper coated Kevlar/graphite/inert material cases (A, B, and C). The intercalated graphite (D) ($\rho = 10^7$ mhos/meter) with no copper coating is not as good as the copper-coated Kevlar that is less expensive and stronger. It is apparent that there is a significant dependence upon the number of strands. However, the use of regular graphite (E) ($\rho = 72{,}000$ mhos/meter) produces a very poor cable with excessive attenuation even with 3,000 strands.

There is an optimal set of parameters visible within the data of FIG. 10. Typical optimal results are graphically displayed in FIG. 11. Both figures provide results of all four frequencies. The optimal condition can be observed in several ways. For example, consider the 3000 strand cases for radius, $r_2$, having values of 0.0005 m and 0.0010 m. Case B with 2 microns copper coating has less attenuation than Case A or Case C that have more or less copper and thus less or more dielectric material. For all the values of N with fixed $r_2$, frequency, and type of conductors, the lowest attenuation has been found. These sets of parameters are presented in FIG. 11. Again, it is apparent that "the bigger the better" is valid here to the extent that a larger value of $r_2$ permits optimization of parameters that provide lower attenuation.

The results for the optimization are understood with least effort by studing FIG. 11. In general there are trends. Optimal attenuation increases with frequency and decreases with cable size (radius, $r_2$, here) and thickness of copper. The attenuation can be 6 dB per 1000 feet at 500 kHz for cables with radius, $r_2$, of 0.002 m. This is achieved by using a few thousand strands of copper-coated material such as Kevlar and winding it into a litz bundle.

The litz bundle is traditionally regarded as being a conductor composed of a number of fine, separately insulated strands which are woven together so that each strand successively takes up all possible positions in the cross-section of the entire conductor. An advantage of a litz bundle or wire is that it gives a reduced skin effect; hence, lower resistance to high frequency currents. Here the metallized strands may be dipped in a suitable dielectric, such as schellac, prior to being bundled together. Optionally the metallized fibers need not be so coated with the dielectric.

For the optimizations, referred to above, the number of strands of wire required changes opposite to the change in attenuation, namely, the number of strands decreases as frequency of optimization increases. At 100 kHz the optimal attenuation for a cable with $r_2=0.002$ m would be approximately 1.5 dB with 5,000 strands of 8.4 microns diameter inert material surrounded by a 3 micron thick coating of copper. The same cable optimized for 500 kHz would have 5.5 dB per 1000 feet attenuation with approximately 1700 strands.

Favorable cable advances are possible with the development of litz-stranded undersea cables with seawater returns. If cables with 0.002 m (0.080 inch) diameter are acceptable, attenuations can be achieved that are reasonable.

From the foregoing the mathematical modeling, design and analysis of cables of many kinds is possible. A promising new cable technology is litz-stranded inner conductors with seawater return. The use of the very strong Kevlar fiber or graphite strands with copper-coating offers substantial improvement for cable technology including cost and size considerations. Both coaxial cables and shielded pair cables are sound designs. Each of these has advantages compared to the other. The coaxial cable costs less than the shielded-pair cable but the latter provides a balanced electrical system that wll be useful in some noise situations. There are indications that the coaxial cable has lower attenuation for equal size conductors. However, there is evidence to suggest the conclusion that the shielded pair may have even lower attenuation for optial choices of inner radii and conductor spacing, S. Thus, the tradeoff leads us to the conclusion that both type cables have merit in their own right.

The tradeoff between included fiber load bearing or balanced-pair design with an outer conductor (not with sea-water return) have included fiber load bearing materials with low conductivity. Solid unmetallized synthetic conductors such as intercalated graphite conductors and conducting polymers may yield favorable designs for conductivities between 0.01 and 0.1 that of copper. With such conditions, it is possible to have attenuations of 10 dB/1000 ft. for cable diameters of 0.2 inch and conductivity ratios of 0.01. If the conductivity can be improved to 0.1 that of copper, the diameter can be reduced to 0.05 inch.

The conductive polymers lend themselves favorably to this concept since they possess some favorable properties such as the very high strength of graphite.

Obviously, many modifications and variations of the present invention are possible in the light of the above teachings. It is therefore to be understood that within the scope of the appended claims the invention may be practiced otherwise than as specifically described.

What is claimed is:

1. A method of fabricating an essentially neutrally buoyant undersea data communications link having a low resistance for transmitting in a frequency range having a 100 kHz upper limit comprising:

providing a bundle of at least one hundred continuous synthetic fibers each having a diameter of between eight and ten microns, weight of between 1.75 and 2.02 gm/cm$^3$ and a tensile strength in the range of 200,000–400,000 lbs/in$^2$ (1.4–2.8 GPa);

coating each continuous synthetic fiber with a metallized layer to a one to three micron thickness, the metallized layer having a DC resistance of approximately one ohm per foot for a 100 fiber bundle; and covering the metallized layer coated continuous synthetic fiber bundle with a dielectric insulation.

2. A method according to claim 1 further including: encasing the dielectric insulation with a metallic conductor.

3. A method according to claim 1 in which the step of providing includes the clustering of no more than 6000 metallized layer coated continuous synthetic fibers in a core that is collectively covered by the dielectric insulation.

4. A method according to claim 2 in which the step of providing includes the clustering of no more than 6000 metallized layer coated continuous synthetic fibers in a core that is collectively covered by the dielectric insulation.

5. A method according to claim 1 in which each of the bundle of the continuous synthetic fibers in the step of providing is an aromatic polyamide fibrillar form and the step of coating is alternatively the electrochemical and chemical deposition of a layer of copper as the metallized layer.

6. A method according to claim 1 in which each of the bundle of the continuous synthetic fibers in the step of providing is a graphite fibrillar form and the step of coating is alternatively the electrochemical and chemical deposition of a layer of copper as the metallized layer.

7. A method according to claim 1 in which each of the bundles of continuous synthetic fibers in the step of providing is a graphite fibrillar form and the step of coating is alternatively the electrochemical and chemical deposition of a layer of aluminum as the metallized layer.

8. A method according to claim 1 in which each of the bundles of continuous synthetic fibers in the step of providing is an aromatic polyamide fibrillar form and the step of coating is alternatively the electrochemical and chemical deposition of a layer of aluminum as the metallized layer.

9. A method according to claim 1 in which the step of providing includes the locating of two spaced apart bundles of the continuously extending synthetic fibers within the dielectric insulation.

10. A method according to claim 2 in which the step of providing includes the locating of two spaced apart bundles of the continuously extending synthetic fibers within the dielectric insulation.

* * * * *